US005219307A

United States Patent [19]

Morrison

[11] Patent Number: 5,219,307

[45] Date of Patent: Jun. 15, 1993

[54] CONVERTIBLE RECREATIONAL RAFT

[76] Inventor: James F. Morrison, 2 Saunders Rd., Lynnfield, Mass. 01940

[21] Appl. No.: 945,391

[22] Filed: Sep. 16, 1992

[51] Int. Cl.[5] ..... B63B 35/58

[52] U.S. Cl. ..... 441/38; 114/264; 114/346; 441/129

[58] Field of Search ..... 441/35, 38, 40, 67, 441/129, 131; 114/346, 264

[56] References Cited

U.S. PATENT DOCUMENTS

| | | | |
|---|---|---|---|
| 3,021,536 | 2/1962 | Haggerty | 444/40 |
| 3,080,584 | 3/1963 | Brown | 441/67 |
| 3,344,764 | 10/1967 | Ziermann | 114/346 X |
| 3,619,833 | 11/1971 | Keller | 441/35 |
| 3,628,206 | 12/1971 | Mecham | 114/346 X |
| 3,789,446 | 2/1974 | Rudelick | 114/264 X |
| 4,828,520 | 5/1989 | Baughman et al. | 441/38 X |

*Primary Examiner*—Sherman Basinger

[57] ABSTRACT

A convertible recreational raft that can be used on a pool or lake, comprising a floating raft defining a relatively large central opening to surround the users. By itself the buoyant raft provides recreational opportunities. A mesh material may be stretched over and releasably fastened to the top of the raft to form a closed interior whereby the only entry is from the water by way of the opening in the raft, so that insects are precluded from reaching the users; the raft also provides privacy and protection from cool breezes for users in the closed interior. A rigid panel, the top of which provides a raised deck for sunbathing or diving may also be releasably fastened to the top of the raft. This configuration also results in a closed interior below the panel and within the raft inner perimeter that provides privacy and protection from cool breezes for users.

1 Claim, 3 Drawing Sheets

CONVERTIBLE RECREATIONAL RAFT

BACKGROUND OF THE INVENTION

1. Field of the Invention

This invention relates in general to the fields of (1) amusement devices, toys and (2) buoys, rafts, and aquatic devices, and in particular to a large aquatic toy that can be converted to either a floating screened structure to protect persons from insects during swimming or to a floating, raised deck for sunbathing, diving, etc.

2. Description of Related Art

Large, floating aquatic toys and floating, raised decks for sunbathing or diving make swimming more enjoyable. If these devices also provide a degree of privacy and protection from cool breezes additional pleasure is gained.

In many areas, particularly at dusk and after dark when the air has cooled and the water is more enjoyable because it seems warmer, the unpleasant assault of biting insects prevents enjoyable swimming or bathing in outdoor pools or lakes.

A raft that can be converted from a buoyant aquatic toy to a floating, raised deck or a floating screened structure will provide significant enjoyment for swimmers in pools or lakes.

In order to provide background information so that the present invention may be completely understood and appreciated in its proper context, reference is made to a prior art patent as follows.

U.S. Pat. No. 5,048,551 to Schelfhaudt discloses a personal floating insect screen that includes:

(a) a floating base member having a perimeter defining an unclosed area on the water surface of sufficient size to surround one human torso, (b) frame members above and attached to said base that are relatively upright and rigid, constructed of rigid plastic tubing, such as PVC pipe, or aluminum, wood, etc, (c) insect screening attached to frame and base to preclude insects from within the structure, (d) various accessories such as an anchor, drogue, etc.

Although an insect-free swimming space is provided by the resultant device, the upper rigid frame members make the device complex and therefore expensive to manufacture; the device is intended for only one person; if structure is damaged repair is relatively expensive; it provides little privacy and no protection from cool breezes; it requires considerable storage space when not in use; its appearance is not particularly pleasing; and it has no alternative recreational purposes.

Whatever the precise merits, features, and advantages of the above cited reference, it does not achieve or fulfill the purposes of the present invention.

SUMMARY OF THE INVENTION

The principal objects of this invention are to provide:

A floating aquatic toy of considerable buoyancy having a relatively large central opening, that can be easily converted into:

(a) a screened, floating device that effectively protects swimmers from biting insects, and (b) a floating, raised deck for sunbathing, diving, etc.

Another object is to provide a devive which is of simple, inexpensive construction, whose parts can be repaired or inexpensively replaced if damaged.

Another object is to provide a device that can be easily moved around the swimming area by the users.

Another object is to provide a degree of privacy for swimmers.

Another object is to provide protection for swimmers from cool breezes.

Another object is to provide an attractive device that compliments the look of a swimming area.

Another object is to provide a device that, if constructed from inflatable materials, can be compressed into a small volume for convenient storage when not in use, and which can be quickly and easily reconstructed when desired.

These objects are achieved, according to the present invention, by providing a device that is comprised of a floating raft that by itself is an aquatic toy. It is of sufficient buoyancy to support at least one human torso and has a relatively large central opening. When raft is floating on water surface, height from water surface to top of raft is such that the top of a human swimmer's head is below the top of the raft when the entire head is above the water surface.

To convert device to an insect-free enclosure, a sheet of mesh material whose overall dimensions are somewhat less than the outer perimeter of the raft is stretched over and releasably fastened near the top of the raft, defining a volume below the screen within the raft inner perimeter above the water surface that is free from insects. The users may position upper portions of their torsos within the opening of the raft, such that all parts of the bodies exposed above the water are within the interior of the device. The screen does not significantly impede air or sunlight but the raft offers both protection from cool breezes and privacy. Various devices and accessories such as handholds to assist in maintaining oneself within the insect-free volume when in deep water may be an integral part of or attached to the raft.

To convert device to a floating, raised deck a panel of thin, rigid material with slightly larger outer dimensions than the mesh material is releasably fastened to a second set of fasteners near the top of the raft to form a raised deck, on top of which users can sunbathe, dive from, etc. The area below the panel within the raft inner perimeter above the water surface provides both protection from cool breezes and privacy. The insect screening may remain fastened to the raft or it may removed according to the users needs or desires.

When the invention is not in use both the panel and mesh material can be unfastened from the raft and the mesh material rolled up or folded for storage. The panel, if not constructed in one piece, may be stacked or folded for storage. The raft, if constructed of inflatable materials, can be deflated and also folded for storage.

BRIEF DESCRIPTION OF THE DRAWINGS

FIG. 2 is a cross-section taken along section lines 8—8 of FIG. 1.

FIG. 5 is a cross-section taken along section lines 9—9 of FIG. 4.

FIG. 8 is a cross-section taken along section lines 10—10 of FIG. 7.

DESCRIPTION OF THE PREFERRED EMBODIMENT

Figure 1:
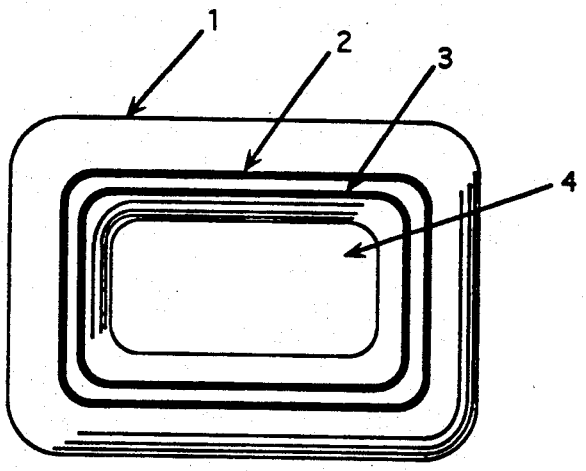
FIG. 1, 2, and 3 are views of the preferred embodiment of the raft.

As shown in the drawings, the preferred embodiment of the device in accordance with the present invention is generally comprised of raft 1 incorporating two sets of releasable fasteners 2 and 3 near its top. The raft has an unclosed central opening 4 and floats on water surface 6. Either a sheet of mesh material 5 or a rigid panel member 7 or both may be fastened to raft 1. When either screen material 5 or panel member 7 is releasably fastened to top of raft 1 an enclosed interior area is defined whereby the only entry is up through the water surface 6 through central opening 4.

Figure 2:
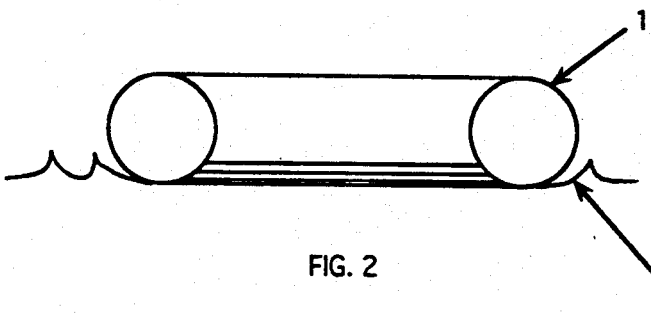
Figure 3:
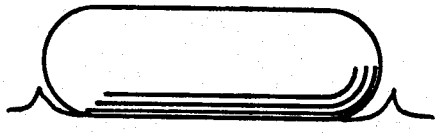

As shown it FIGS. 1, 2, and 3, floating raft 1 forms a closed perimeter structure defining a relatively large central opening 4, and is of sufficient buoyancy to support at least one human torso above the surface of the water 6. Raft 1 is sized such that when the raft 1 is floating on the water surface 6, the distance from the surface of the water 6 to the top of raft 1 is such that the top of a human's head is below the top of raft 1 when the entire head is above the surface of the water 6. The opening 4 must be of sufficient size to surround the upper torso of at least 1 human. Raft 1 can be constructed of any material that provides sufficient buoyancy such as cork, plastic (self floating or inflatable), foam, etc.

The particular shape of the raft 1 and the opening 4 is a matter of design choice. Raft 1 may be approximately rectangular as shown in the figures, or circular or any other shape that allows the insect screen 5 and rigid panel 7 to remain stable on the raft 1 when on the surface of the water.

Figure 4:
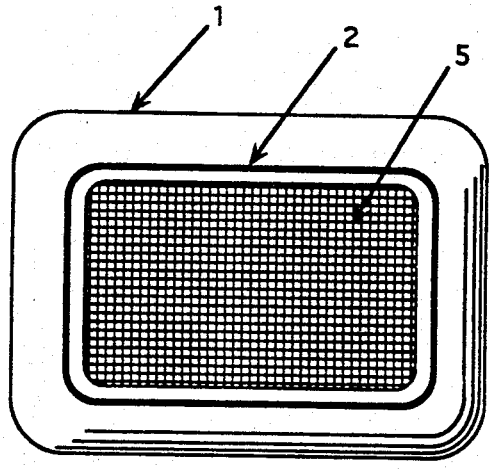
FIG. 4, 5, and 6 are views of the preferred embodiment of the raft with mesh material fastened.
Figure 5:
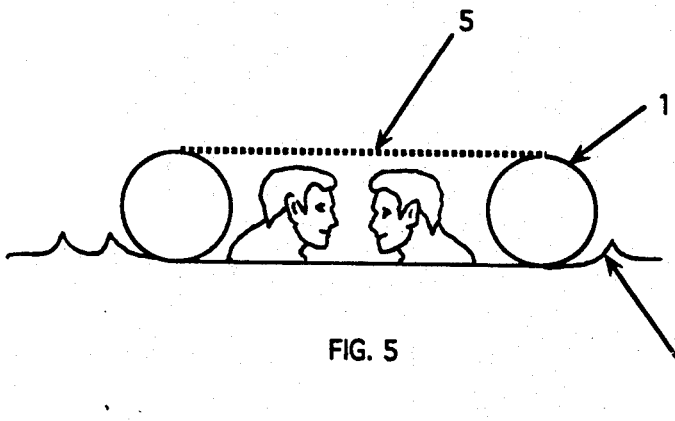
Figure 6:
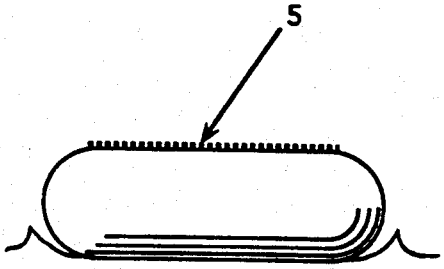

As shown in FIGS. 4, 5, and 6, mesh material 5 may be stretched across top of raft 1 to define an enclosed interior area below screen material 5 and within central opening 4 and above the surface of the water 6. Mesh material 5 may be of any suitable material having relatively small openings to preclude insects from traveling through the material. Common metal or plastic screening is ideally suitable for this. It may be a single sheet or several separate smaller sheets or several smaller sheets attached to one another by suitable devices. It may include rigid or flexible materials suitably attached to selected areas for reinforcement. Mesh material 5 is releasably fastened to raft 1 by any suitable releasable fastener 3 such as snaps, zippers, etc. An alternate releasable fastener configuration requires cooperating surfaces of screen material 5 and raft 1 facing each other, with screen material 5 carrying a plurality of small hook-like members in position to engage a felt-like material carried by top of raft 1, or vice-versa. With whatever method is used, the screen material 5 must completely cover the top of the raft opening 4, such that the only opening of significant size to the interior of the device is up through the water surface 6 through the bottom of opening 4.

Figure 7:
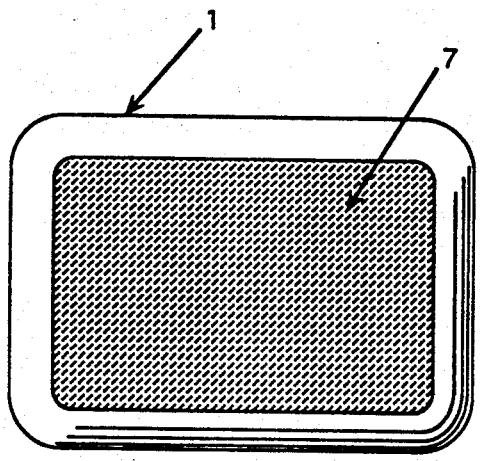
FIG. 7, 8, and 9 are views of the preferred embodiment of the raft with mesh material and rigid panel fastened.
Figure 8:
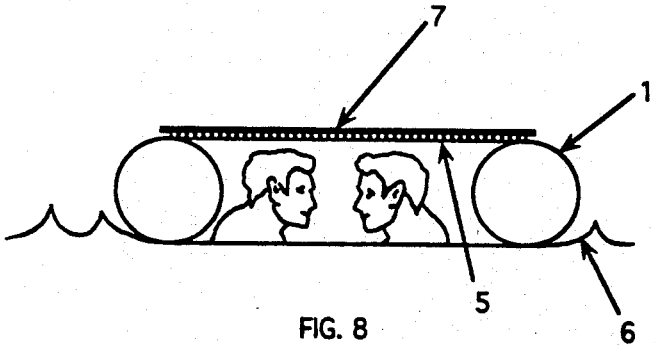
Figure 9:
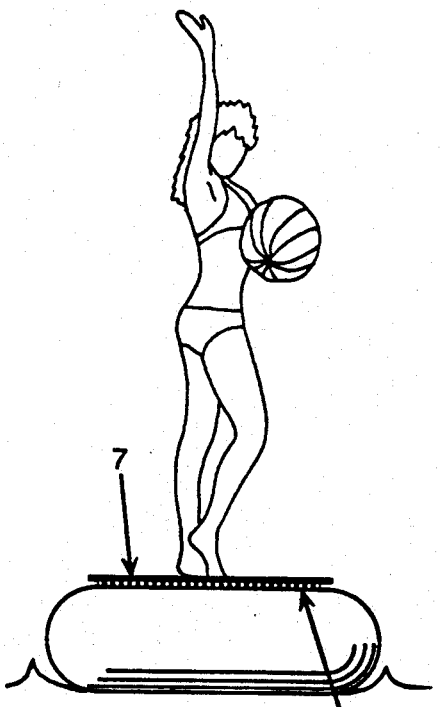

As shown in FIGS. 7, 8, and 9, when desired by the user rigid panel 7 is releasably fastened to top of raft 1 to define a raised deck. Panel 7 may be of any suitable material and thickness having sufficient rigidity to support at least one human, such as plastic, aluminum, wood, etc. It may be constructed of one panel or several separate panels or several panels attached to one another by hinges or other suitable devices. Panel member 7 is releasably fastened to raft 1 by any suitable releasable fastener 2 such as snaps, zippers, etc. An alternate releasable fastener configuration requires cooperating surfaces of panel 7 and raft 1 facing each other, with panel member 7 carrying a plurality of small hook-like members in position to engage a felt-like material carried by facing surface of raft 1, or vice-versa.

The foregoing description of the preferred embodiment of the invention has been presented for the purpose of illustration and description. It is not intended to be exhaustive or to limit the invention to the precise form disclosed. Many modifications and variations are possible in light of the above teaching. It is intended that the scope of the invention be limited not by this detailed description, but rather by the following claims.

I claim:

1. A raft that floats on the surface of the water, said raft having buoyancy to support at least one human torso above said surface of the water; said raft having a perimeter defining a relatively large, unclosed opening on said water surface of sufficient size to surround at least one human torso; said raft when floating on said surface of water having a height such that distance from said surface of water to top of said raft is such that the top of said human's head is below the top of said raft when entire said head is above said surface of the water; said raft including two sets of releasably fastening devices suitably attached at or near top of said raft; a sheet of mesh material that is releasably fastened to top of said raft, said mesh material and said raft defining a closed interior area above said water surface, whereby said large opening in said raft provides the only entry into said interior area, said mesh material having openings sufficiently small in size to prevent insects from entering said interior area; a panel of rigid material that is releasably fastened to top of said raft, said panel and said raft providing a raised deck capable of supporting at least one human on top of said deck with said deck remaining above said water surface, and said deck and said mesh material and said raft defining a closed interior area above said water surface, whereby said large opening in said raft provides the only entry into said interior area.

* * * * *